US011274829B2

(12) United States Patent
Graves et al.

(10) Patent No.: US 11,274,829 B2
(45) Date of Patent: Mar. 15, 2022

(54) SHELL AND TILED LINER ARRANGEMENT FOR A COMBUSTOR

(71) Applicant: Rolls-Royce Corporation, Indianapolis, IN (US)

(72) Inventors: Charles B. Graves, Avon, IN (US); Russell N. Bennett, Indianapolis, IN (US); William G. Cummings, III, Indianapolis, IN (US); Jun Shi, Carmel, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 129 days.

(21) Appl. No.: 16/577,589

(22) Filed: Sep. 20, 2019

(65) Prior Publication Data

US 2020/0033005 A1 Jan. 30, 2020

Related U.S. Application Data

(63) Continuation of application No. 15/218,668, filed on Jul. 25, 2016, now Pat. No. 10,458,652, which is a continuation of application No. 14/135,350, filed on Dec. 19, 2013, now Pat. No. 9,423,129.

(60) Provisional application No. 61/798,253, filed on Mar. 15, 2013.

(51) Int. Cl.
*F23R 3/00* (2006.01)
*F23R 3/60* (2006.01)

(52) U.S. Cl.
CPC ..... *F23R 3/002* (2013.01); *F23R 3/007* (2013.01); *F05D 2260/201* (2013.01); *F23R 3/60* (2013.01); *F23R 2900/00017* (2013.01); *F23R 2900/03044* (2013.01); *Y10T 29/49229* (2015.01)

(58) Field of Classification Search
CPC .. F23R 3/002; F23R 3/007; F23R 3/60; F23R 3/08; F23R 2900/00017; F23R 2900/00018; F23R 2900/03044; F23M 2900/05004; F02K 3/10; F05D 2260/201; Y10T 29/49229
See application file for complete search history.

(56) References Cited

U.S. PATENT DOCUMENTS

| | | | |
|---|---|---|---|
| 2,709,894 | A | 6/1955 | Oulianoff et al. |
| 2,760,338 | A | 8/1956 | Keast |
| 3,899,876 | A | 8/1975 | Williamson et al. |
| 3,918,255 | A | 11/1975 | Holden |
| 4,222,300 | A | 9/1980 | El Habr |
| 4,236,378 | A | 12/1980 | Vogt et al. |
| 4,480,436 | A | 11/1984 | Maclin |

(Continued)

FOREIGN PATENT DOCUMENTS

EP 1801502 A2 6/2007

*Primary Examiner* — Gerald L Sung
*Assistant Examiner* — Rene D Ford
(74) *Attorney, Agent, or Firm* — Barnes & Thornburg LLP

(57) ABSTRACT

A combustor adapted for use in a gas turbine engine is disclosed. The combustor includes a metallic shell forming a cavity and a ceramic liner arranged in the cavity of the metallic shell. The ceramic liner defines a combustion chamber in which fuel is burned during operation of a gas turbine engine. The ceramic liner includes a plurality of ceramic tiles mounted to the metallic shell and arranged to shield the metallic shell from heat generated in the combustion chamber.

16 Claims, 5 Drawing Sheets

(56) References Cited

U.S. PATENT DOCUMENTS 4,555,901 A 12/1985 Wakeman
4,567,730 A 2/1986 Scott
4,614,082 A 9/1986 Sterman et al.
4,655,044 A 4/1987 Dierberget et al.
4,688,310 A 8/1987 Keim et al.
4,901,522 A 2/1990 Commaret et al.
4,907,411 A 3/1990 Krueger
4,912,922 A 4/1990 Maclin
4,944,151 A * 7/1990 Hovnanian ..... F23R 3/002 60/752
4,975,014 A 12/1990 Rufin et al.
5,079,915 A 1/1992 Veau
5,113,660 A 5/1992 Able et al.
5,291,732 A 3/1994 Halila
5,331,816 A 7/1994 Able et al.
5,333,443 A 8/1994 Halila
5,343,643 A 9/1994 Cochrane
5,363,643 A 11/1994 Halila
5,404,793 A * 4/1995 Myers ..... F02F 1/18 123/195 R
5,445,469 A 8/1995 Huck et al.
5,499,499 A 3/1996 Ambrogi et al.
5,501,071 A 3/1996 Ansart et al.
5,553,455 A 9/1996 Craig et al.
5,592,814 A 1/1997 Palusis et al.
5,598,697 A 2/1997 Ambrogi et al.
5,609,031 A 3/1997 Jones
5,636,508 A 6/1997 Shaffer et al.
5,755,093 A 5/1998 Palusis et al.
5,799,491 A 9/1998 Bell et al.
6,029,455 A 2/2000 Sandelis
6,041,590 A 3/2000 Hayton et al.
6,045,310 A 4/2000 Miller et al.
6,047,539 A 4/2000 Farmer et al.
6,102,610 A 8/2000 Palusis et al.
6,223,538 B1 5/2001 Benz et al.
6,334,298 B1 1/2002 Aicholtz
6,408,628 B1 6/2002 Pidcock et al.
6,422,620 B1 7/2002 Jordening
6,571,560 B2 6/2003 Tatsumi et al.
6,708,495 B2 3/2004 Calvez et al.
6,718,774 B2 4/2004 Razzell
6,775,985 B2 8/2004 Mitchell et al.
6,823,676 B2 11/2004 Conete et al.
6,830,437 B2 12/2004 Cairo et al.
6,895,757 B2 5/2005 Mitchell et al.
6,895,761 B2 5/2005 Mitchell et al.
6,904,757 B2 6/2005 Mitchell et al.
6,931,855 B2 8/2005 Glessner et al.
7,059,133 B2 6/2006 Gerendas
7,093,441 B2 8/2006 Burd et al.
7,140,185 B2 11/2006 Burd et al.
7,153,054 B2 12/2006 Arbona
7,237,389 B2 7/2007 Ryan et al.
7,261,489 B2 8/2007 Arbona et al.
7,291,407 B2 11/2007 Merrill et al.
7,363,763 B2 4/2008 Coughlan et al.
7,464,554 B2 12/2008 Cheung et al.
7,546,743 B2 6/2009 Bulman et al.
7,647,779 B2 1/2010 Shi et al.
7,665,307 B2 2/2010 Burd et al.
7,805,945 B2 10/2010 Grote et al.
7,908,867 B2 3/2011 Keller et al.
7,926,278 B2 4/2011 Gerendas et al.
7,942,004 B2 5/2011 Hodder
7,950,234 B2 5/2011 Radonovich et al.
8,015,829 B2 9/2011 Coughlan et al.
8,074,453 B2 12/2011 Gerendas et al.
8,113,004 B2 2/2012 Carlisle et al.
8,118,546 B2 2/2012 Morrison
8,122,727 B2 2/2012 Shi et al.
8,141,371 B1 3/2012 Habarou et al.
8,146,372 B2 4/2012 Carrere et al.
8,256,223 B2 9/2012 Dierberger et al.
8,256,224 B2 9/2012 Garry et al.
8,281,598 B2 10/2012 Gerendas et al.
8,359,865 B2 1/2013 Dierberger et al.
8,359,866 B2 1/2013 Dierberger et al.
8,556,531 B1 10/2013 Bird et al.
2005/0086940 A1* 4/2005 Coughlan, III ..... F23R 3/002 60/752
2008/0104963 A1 5/2008 Grote et al.
2008/0264064 A1* 10/2008 Sze ..... F23R 3/06 60/752
2010/0251721 A1 10/2010 Morrison et al.
2011/0027569 A1 2/2011 Richards
2011/0030378 A1 2/2011 Carlisle
2011/0185737 A1 8/2011 Dierberger et al.
2011/0185740 A1 8/2011 Dierberger et al.
2012/0144835 A1 6/2012 Taylor et al.
2012/0198854 A1 8/2012 Schilp et al.
2012/0210719 A1 8/2012 Dierberger et al.
2012/0234402 A1 9/2012 Richards
2012/0275900 A1 11/2012 Snider et al.
2013/0019603 A1 1/2013 Dierberger et al.
2014/0360196 A1 12/2014 Graves et al.
2015/0330633 A1 11/2015 Graves et al.

* cited by examiner

SHELL AND TILED LINER ARRANGEMENT FOR A COMBUSTOR

CROSS-REFERENCE TO RELATED APPLICATIONS

This application is a continuation of U.S. patent application Ser. No. 15/218,668, filed 25 Jul. 2016, which is a continuation of U.S. patent application Ser. No. 14/135,350, filed 19 Dec. 2013, which in turn claims the benefit of and priority to U.S. Provisional Patent Application Ser. No. 61/798,253, filed Mar. 15, 2013, all of which are incorporated by reference in their entirety herein.

FIELD OF THE DISCLOSURE

The present disclosure relates generally combustors used in gas turbine engines; more particularly, the present disclosure relates to a combustor including a metallic shell and a liner made up of ceramic tiles.

BACKGROUND

Engines, and particularly gas turbine engines, are used to power aircraft, watercraft, power generators and the like. Gas turbine engines typically include a compressor, a combustor, and a turbine. The compressor compresses air drawn into the engine and delivers high pressure air to the combustor. The combustor is a component or area of a gas turbine engine where combustion takes place. In a gas turbine engine, the combustor receives high pressure air and adds fuel to the air which is burned to produce hot, high-pressure gas. After burning the fuel, the hot, high-pressure gas is passed from the combustor to the turbine. The turbine extracts work from the hot, high-pressure gas to drive the compressor and residual energy is used for propulsion or sometimes to drive an output shaft.

Combustors include liners that contain the combustion process during operation of a gas turbine engine. The liner included in the combustor is designed and built to withstand high-temperature cycles induced during combustion. In some cases, liners may be made from metallic superalloys. In other cases, liners may be made from ceramic matrix composites (CMCs) which are a subgroup of composite materials as well as a subgroup of technical ceramics. CMCs may comprise ceramic fibers embedded in a ceramic matrix, thus forming a ceramic fiber reinforced ceramic (CFRC) material. The matrix and fibers can consist of any ceramic material, whereby carbon and carbon fibers can also be considered a ceramic material.

Combustors and turbines made of metal alloys require significant cooling to be maintained at or below their maximum use temperatures. The operational efficiencies of gas turbine engines are increased with the use of CMC materials that require less cooling and have operating temperatures that exceed the maximum use temperatures of metal alloys. The reduced cooling required by CMC combustor liners when compared to metal alloy combustion liners permits greater temperature uniformity and thereby leads to reduced NOx emissions.

One challenge relating to the use of CMC tiles is that they are sometimes secured to the surrounding metal shell via metal fasteners. Metal fasteners lose their strength and may even melt at CMC operating temperatures. Since the allowable operating temperature of a metal fastener is lower than the allowable operating temperature of the CMC, metal fasteners, and/or the area surrounding it, is often cooled to allow it to maintain its strength. Such a configuration may undermine the desired high temperature capability of the CMC. Accordingly, new techniques and configurations are needed for securely fastening liner material, such as CMC tiles, to the walls of enclosures experiencing high-temperature environments.

SUMMARY

The present disclosure may comprise one or more of the following features and combinations thereof.

A combustor adapted for use in a gas turbine engine is disclosed in this paper. The combustor includes a metallic shell forming a cavity and a ceramic liner arranged in the cavity of the metallic shell. The ceramic liner defines a combustion chamber in which fuel is burned during operation of a gas turbine engine. The ceramic liner includes a plurality of ceramic tiles coupled to the metallic shell and arranged to shield the metallic shell from heat generated in the combustion chamber.

In illustrative embodiments, the plurality of ceramic tiles are coupled to the metallic shell by metallic fasteners. Many of the metallic fasteners may be shielded from heat generated in the combustion chamber by portions of adjacent ceramic tiles coupled to the metallic shell. By shielding the metallic fasteners from the combustion chamber, the metallic fasteners can survive temperatures in the combustor.

In illustrative embodiments, the fasteners coupling an individual ceramic tile to the metallic shell may extend through preformed apertures in the ceramic tile. The preformed apertures may be sized to locate the ceramic tile while also allowing for expansion/contraction of the ceramic tile as the ceramic tile is heated/cooled during use of the combustor. In particular, a single round locator hole may receive a locator fastener locating a ceramic tile and a plurality of elongated securement slots may receive a plurality of securement fasteners so that the ceramic tile can expand and contract while the securement slots move around the securement fasteners.

In illustrative embodiments, the shell is formed to include a number of dimples that extend toward the combustion chamber and are received in corresponding hollows formed in the ceramic tiles. The dimples and hollows may be correspondingly sized so that a substantially uniform, predetermined distance is maintained between the dimples and the portion of the ceramic tiles forming the hollow. By maintaining a substantially uniform, predetermined distance, heat transfer from the ceramic tiles to the shell can be evenly distributed. In some embodiments, holes may be formed through the dimples to allow cooling air to be supplied to the ceramic tiles.

These and other features of the present disclosure will become more apparent from the following description of the illustrative embodiments.

DETAILED DESCRIPTION

Figure 1:
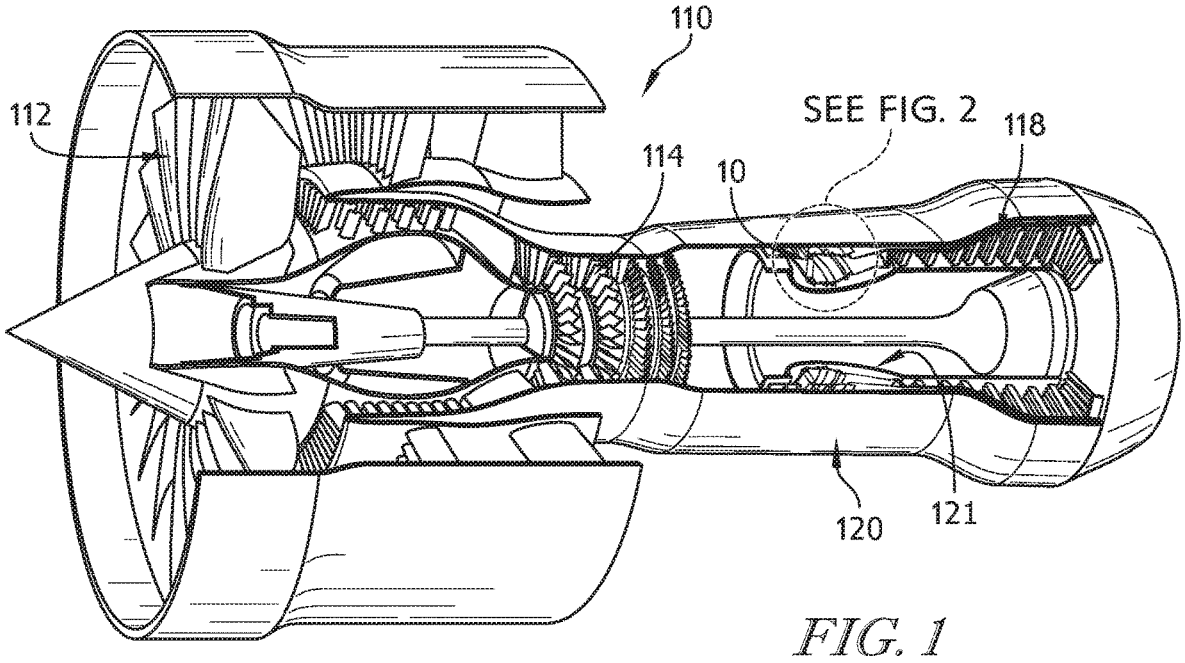
FIG. 1 is a cut-away view of a gas turbine engine including a combustor in accordance with the present disclosure.

For the purposes of promoting an understanding of the principles of the disclosure, reference will now be made to a number of illustrative embodiments illustrated in the drawings and specific language will be used to describe the same.

The arrangement of an illustrative high-temperature combustor 10 in a gas turbine engine 110 is shown in FIG. 1. The gas turbine engine 110 includes a fan 112, a compressor 114, the combustor 10, and a turbine 118 all mounted to a case 120. The fan 112 is driven by the turbine 118 and provides thrust for propelling a vehicle (not shown). The compressor 114 is configured compress and deliver air to the combustor 10. The combustor 10 is configured to mix fuel with the compressed air received from the compressor 114 and to ignite the fuel. The hot, high pressure products of the combustion reaction in the combustor 10 are directed into the turbine 118 and the turbine 118 extracts work to drive the compressor 114 and the fan 112.

Figure 2:
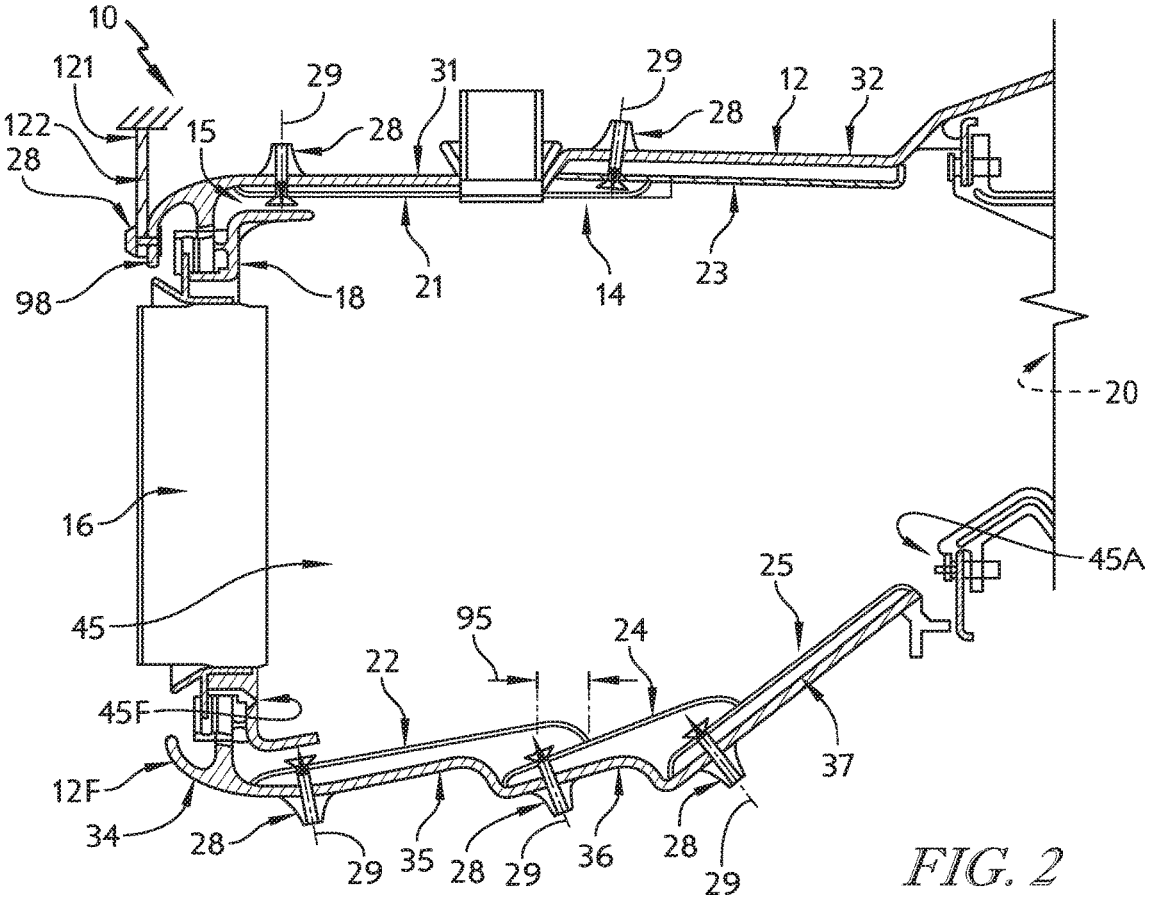
FIG. 2 is a partial cross-sectional view of the combustor shown in FIG. 1 showing that the combustor includes a metallic shell, a ceramic liner made up of a plurality of ceramic tiles, a fuel nozzle, and a heat shield.

The combustor 10 includes a shell 12, a liner 14, fuel nozzles 16, and a heat shield 18 as shown, for example, in FIG. 2. The shell 12 is constructed from a metallic material and defines an annular cavity 15. The liner 14 arranged inside the cavity 15 defined by the shell 12 and extends around an annular combustion chamber 45 in which fuel is ignited to produce hot, high-temperature gases that drive the gas turbine engine 110. The fuel nozzles 16 are arranged at circumferential intervals around an axially forward end 45F of the combustion chamber 45 and provides fuel to the combustion chamber 45. The heat shield 18 is arranged to protect a forward side 12F of the shell 12. The combustor 10 feeds hot, high-pressure gas to a vane ring assembly 20 arranged at an axially aft end 45A of the combustion chamber 45 and that is used to drive the turbine 118 of the gas turbine engine 110.

The shell 12 illustratively includes an outer shell member 30 and an inner shell member 34 that is generally concentric with and nested inside the outer shell member 30. To expand the size of the cavity 15, the outer shell member 30 is formed to include a plurality of radially offset steps (or joggles) 31, 32 and the inner shell member 34 is formed to include a plurality of radially offset steps (or joggles) 35, 36, 37 as shown in FIG. 2.

The liner 14 is illustratively assembled from a plurality of ceramic tiles 21-25 secured to the shell 12 by a plurality of metallic fasteners 28 as shown in FIG. 2. In the illustrative embodiment, each tile 21-25 is one of a plurality of ceramic tiles that is arranged around the circumference of the outer or inner shell members 30, 34. The fasteners 28 are illustratively arranged to extend through corresponding ceramic tiles 21-25 along an axially forward side of the ceramic tiles 21-25. Thus, the ceramic tiles 21-25 are cantilevered and are free to expand and contract in the axial direction. In some embodiments, some of the fasteners 28 extend through slots arranged to extend circumferentially around the ceramic tiles 21-25 so that the ceramic tiles 21-25 are allowed to expand and contract in the circumferential direction.

The heat shield 18 is arranged at the axially forward end 12F of the shell 12 as shown in FIG. 2. The heat shield extends between the combustion chamber 45 and the fasteners 28 securing axially-forward ceramic tiles 21, 22 to the shell 12 so that the fasteners 28 are shielded from heat generated in the combustion chamber 45. Openings 38 in the heat shield 18 allow the fuel nozzles 16 to access the combustion chamber 45.

The ceramic tiles 21-25 are illustratively arranged so that fasteners 28 securing axially-aft ceramic tiles 23, 24, 25 are shielded from heat generated in the combustion chamber by axially-adjacent ceramic tiles 21, 22, 24 as shown in FIG. 2. More particularly, axially-forward ceramic tiles 21, 22 are arranged to overlap the fasteners 28 securing axially-adjacent ceramic tiles 23, 24 along with a portion of the axially-intermediate tiles 23, 24 surrounding the fasteners 28. Similarly, axially-intermediate tiles 24 are arranged to overlap the fasteners 28 securing axially-adjacent ceramic tiles 25 along with a portion of the axially-adjacent tiles 25 surrounding the fasteners 28. In some embodiments, more or fewer axially-arranged rows of ceramic tiles may be added to accommodate longer or shorter combustor designs.

As a result of the overlapped arrangement of the ceramic tiles 21-25, the fasteners 28 experience lower temperatures than are presented in the combustion chamber 45 as suggested in FIG. 2. The lower temperatures experienced by the fasteners 28 allow the fasteners 28 to have longer useful lives and may reduce or eliminate the need for cooling air to be supplied to the fasteners 28. In addition, by lowering temperatures experienced around the fasteners 28, harmful thermal gradients induced in the ceramic tiles 21-25 may be reduced.

Moreover, in the illustrative embodiment, the fasteners 28 are spaced a predetermined distance 95 from the uncovered portion of the tile 21-25 through which they extend as shown in FIG. 2. This predetermined distance 95 is selected based on the distance from the uncovered portion that heat will transfer through the tiles 21-25 to ensure that the temperature will be low enough to be within the useful temperature limit of the fasteners.

In the illustrative embodiment shown in FIGS. 1 and 2, the ceramic tiles 21-25 are formed in two dimensions and have a generally U-shaped cross-section. The ceramic tiles 21-25 are illustratively made from a ceramic matrix composite (CMC) such as silicon-carbide fibers in a silicon-carbide matrix and are adapted to withstand relatively-high temperatures as are produced by the combustion of fuel inside the combustor 10. In other embodiments, the ceramic tiles 21-25 may be made of other ceramic-containing composite materials and/or of monolithic ceramic materials. The shape of the ceramic tiles 21-25 allow the ceramic tiles 21-25 to be simply produced in large quantities.

The fasteners 28 are illustratively made from a metallic material which may provide greater tensile strength and preload capability suitable for the vibratory environment inside the gas turbine engine 110. The illustrative fasteners 28 are configured to receive cooling air from the compressor 112 of the gas turbine engine 110 as suggested by arrows 29 in FIG. 2. The fasteners 28 may be bolts, rivets, or the like. In some embodiments, no cooling air is supplied to the fasteners 28 depending on the fastener material selection and expected temperature of the fasteners during operation.

In other embodiments, full hoop tiles may be used rather than a number of circumferentially-adjacent tiles while still being arranged so that the metallic fasteners 28 are shielded from the heat of combustion. In still other embodiments, a single wall liner Upon securing the ceramic tiles 21-24 included in the liner 14 to the metallic shell 12, the combustor 10 may be mounted to the case 120 of the gas turbine engine 110 as suggested in FIG. 1. More particularly, the combustor 10 can be mounted to a diffuser casing 121 included in the case 120 of the gas turbine engine 110 using conventional methods. In the illustrative embodiment, metal fasteners 28 couple an axially-forward wall 98 of the shell 12 to a radially-extending flange 122 included in the diffuser casing 121 as shown in FIG. 2. In other embodiments, other methods of fastening the shell 12 to the case 120 may be implemented without departing from the spirit of the present disclosure.

Figure 3:
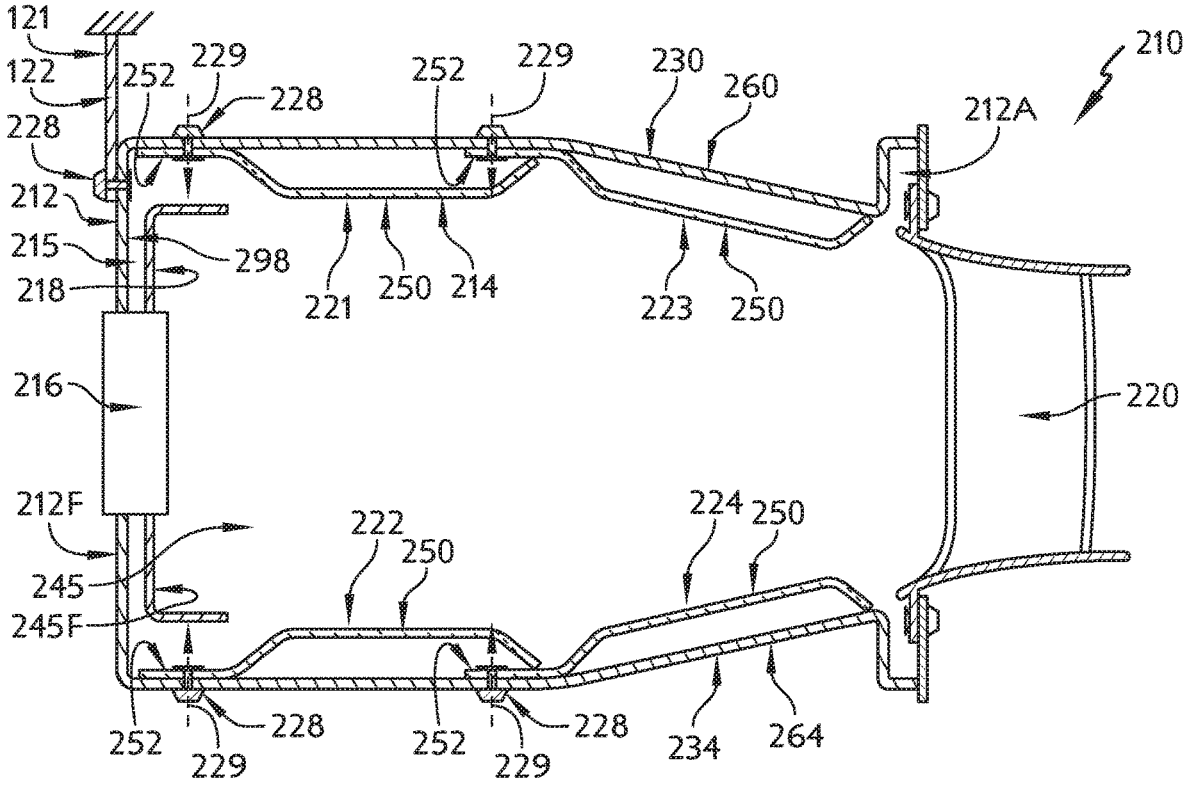
FIG. 3 is a partial cross-sectional view of a second combustor showing that the combustor includes a metallic shell, a ceramic liner made up of a plurality of ceramic tiles, a fuel nozzle, and a heat shield.

Another illustrative combustor 210 adapted for use in the gas turbine engine 110 is shown in FIG. 3. The combustor 210 is substantially similar to the combustor 10 shown in FIGS. 1-2 described herein. Accordingly, similar reference numbers in the 200 series indicate features that are common between the combustor 10 and the combustor 210. The description of the combustor 10 is hereby incorporated by reference to apply to the combustor 210, except in instances when it conflicts with the specific description and drawings of combustor 210.

Unlike the combustor 10, the combustor 210 includes a shell 212 having outer and inner shell members 230, 234 that do not have joggles as shown in FIG. 3. Rather, axially extending walls 260, 264 of the shell 212 are contoured as shown in FIG. 3.

Figure 4:
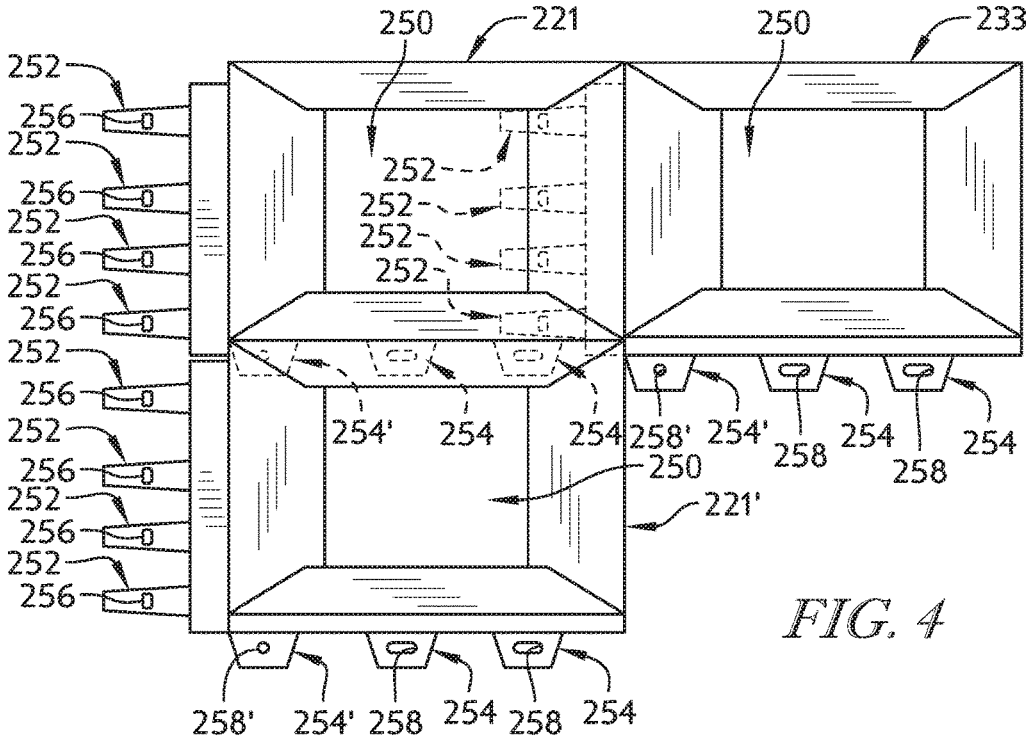
FIG. 4 is an internal plan view of some of ceramic tiles included in the combustor of FIG. 3 showing that the ceramic tiles include preformed apertures that receive fasteners for locating and securing the ceramic tiles to the metallic shell while allowing expansion and contraction of the ceramic tiles in the axial and circumferential directions.

Further, unlike the combustor 10, the combustor 210 includes ceramic tiles 221-224 that each include a body 250, a plurality of axially-extending tabs 252 arranged along an axially-forward side of a corresponding body 250, and a plurality of circumferentially-extending tabs 254 arranged along a circumferential side of a corresponding body 250 as shown in FIG. 4. Metallic fasteners 228 extend through the tabs 252, 254 to couple the ceramic tiles 221-224 to the metallic shell 212.

The body 250 of each ceramic tile 221-224 extends around a portion of the combustion chamber 245 and defines a portion of the combustion chamber 245 as shown in FIG. 3. The body 250 of axially-forward ceramic tiles 221, 222 are arranged to overlap the fasteners 28 securing axially-aft ceramic tiles 223, 224 and axially-extending tabs 252 so that the fasteners 228 and tabs 252 are shielded from heat generated in the combustion chamber 245 as shown in FIGS. 2 and 3. Further, the body 250 of circumferentially-adjacent ceramic tiles (e.g. 221') are arranged to overlap the fasteners 228 securing ceramic tiles (e.g. 221) in a similar axial position and radially-extending tabs 254 so that the fasteners 228 and tabs 254 are shielded from heat generated in the combustion chamber 245 as shown in FIG. 3. In the illustrative embodiment, the body 250 of each ceramic tile 221-224 has a generally U-shaped cross-section.

The axially-extending tabs 252 of each ceramic tile 221-224 extend from the body 250 of a corresponding ceramic tile 221-224 as shown in FIGS. 3 and 4. The axially-extending tabs 252 are arranged radially further away from the combustion chamber 245 than the corresponding body 250 from which they extend. Each tab 252 is formed to include a securement slot 256 through which a securement fastener 228 extends. The securement slots 256 are elongated in the radial direction to allow expansion/contraction of the ceramic tiles 221-224 in the radial direction on account of heating/cooling during operation of the combustor 210.

The circumferentially-extending tabs 254 of each ceramic tile 221-224 extend from the body 250 of a corresponding ceramic tile 221-224 as shown in FIGS. 3 and 4. The circumferentially-extending tabs 254 are arranged radially further away from the combustion chamber 245 than the corresponding body 250 from which they extend. One circumferentially-extending tab 254' is formed to include a round locating hole 258' through which a locating fastener extends. Each other radially-extending tab 254 is formed to include a securement slot 258 through which a securement fastener.

The locating hole 258' included in a radially-extending tab 254' of a ceramic tile 221-224 (and the locating fastener that extends therethrough) locates the corresponding ceramic tile 221-224 relative to the shell 212. The securement slots 258 included in radially-extending tab 254 of a ceramic tile 221-224 are elongated in the axial direction to allow expansion/contraction of the ceramic tiles 221-224 in the axial direction on account of heating/cooling during operation of the combustor 210.

By arranging the fasteners 228 through the tabs 252, 254 the fasteners 28 are spaced a predetermined distance from the uncovered body 250 of the tiles 221-224 as shown in FIG. 3. This predetermined distance is selected based on the distance from the uncovered portion that heat will transfer through the tiles 221-224 to ensure that the temperature of the fasteners 228 will be low enough to be within the useful temperature limit of the fasteners 228.

Figure 5:
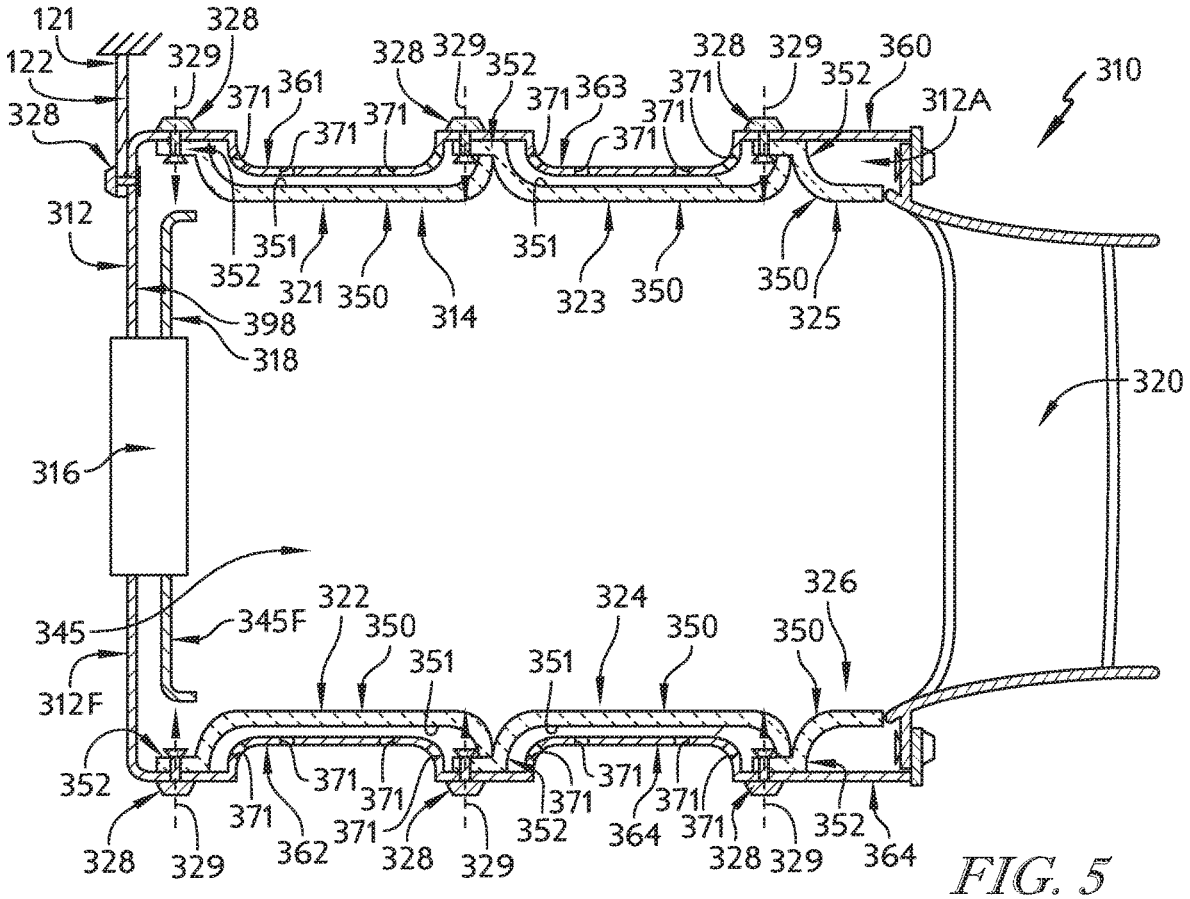
FIG. 5 is a partial cross-sectional view of a third combustor showing that the combustor includes a metallic shell, a ceramic liner made up of a plurality of ceramic tiles, a fuel nozzle, and a heat shield.

Another illustrative combustor 310 adapted for use in the gas turbine engine 110 is shown in FIG. 5. The combustor 310 is substantially similar to the combustor 10 shown in FIGS. 1-2 described herein. Accordingly, similar reference numbers in the 300 series indicate features that are common between the combustor 10 and the combustor 310. The description of the combustor 10 is hereby incorporated by reference to apply to the combustor 310, except in instances when it conflicts with the specific description and drawings of combustor 310.

Unlike the combustor 10, the combustor 310 includes a shell 212 having outer and inner shell members 330, 334 that do not have radial steps as shown in FIG. 5. Rather, the outer shell 330 includes an axially extending wall 360 and a plurality of dimples 361, 363 that extend from the wall 360 toward the combustion chamber 325. Additionally, the inner shell 334 includes an axially extending wall 364 and a plurality of dimples 362, 364 that extend from the wall 364 toward the combustion chamber 325. Each dimple 361-364 includes a plurality of cooling holes 371 that allow cooling air from the compressor 112 to be blown onto the ceramic tiles 321-324.

Figure 6:
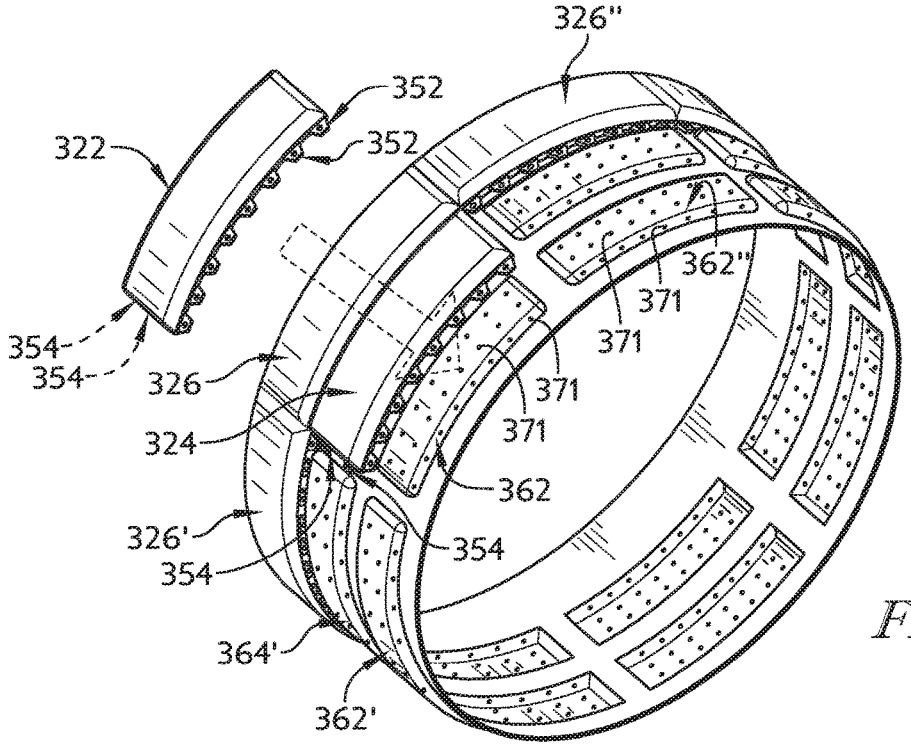
FIG. 6 is a perspective view of a portion of the third combustor shown in FIG. 5 illustrating an inner shell member included in the metallic shell and a plurality of ceramic tiles coupled to the inner shell member and showing that the inner shell member is formed to include dimples that are received in the ceramic tiles.

Further, unlike the combustor 10, the combustor 310 includes ceramic tiles 321-326 that each include a body 350, a plurality of axially-extending tabs 352 arranged along an axially-forward side of a corresponding body 350, and a plurality of circumferentially-extending tabs 354 arranged along a circumferential side of a corresponding body 350 as shown in FIG. 6. Metallic fasteners 328 extend through round holes in the tabs 352, 354 to couple the ceramic tiles 321-326 to the metallic shell 312. In some embodiments, some of the holes through which fasteners 328 extend may be elongated into slots adapted to allow thermal growth of the ceramic tiles 321-326 during operation of the combustor 310.

The body 350 of each ceramic tile 321-326 extends around a portion of the combustion chamber 345 and defines a portion of the combustion chamber 345 as shown in FIG. 3. The body 350 of axially-forward ceramic tiles 321, 322 are arranged to overlap the fasteners 328 securing axially-intermediate ceramic tiles 323, 324 and axially-extending tabs 352 so that the fasteners 328 and tabs 352 are shielded from heat generated in the combustion chamber 345 as shown in FIGS. 5 and 6. Similarly, the body 350 of axially-intermediate ceramic tiles 323, 324 are arranged to overlap the fasteners 328 securing axially-aft ceramic tiles 325, 326 and axially-extending tabs 352 so that the fasteners 328 and tabs 352 are shielded from heat generated in the combustion chamber 345. Further, the body 350 of circumferentially-adjacent ceramic tiles (e.g. 326') are arranged to overlap the fasteners 328 securing ceramic tiles (e.g. 326) in a similar axial position and radially-extending tabs 354 so that the fasteners 328 and tabs 354 are shielded from heat generated in the combustion chamber 345 as shown in FIG. 6.

In the illustrative embodiment, the body 350 of axially-forward and axially-intermediate ceramic tiles 321-324 has a generally U-shaped cross-section and is formed to include a hollow 351 as shown in FIG. 5. The hollows 351 are sized to receive one of the dimples 361-364. The hollows 351 are further sized so that a substantially uniform distance is maintained between the body 350 of a corresponding ceramic tile 321-324 and a dimple 361-364 received in the body 350. Thus, by providing a shorter impingement distance for the cooling air provided, more effective heat transfer away from the ceramic tiles 321-324 may be accomplished. The dimples 361-364 may be manufactured using a stamping, a rolling process, or another suitable process.

Figure 7:
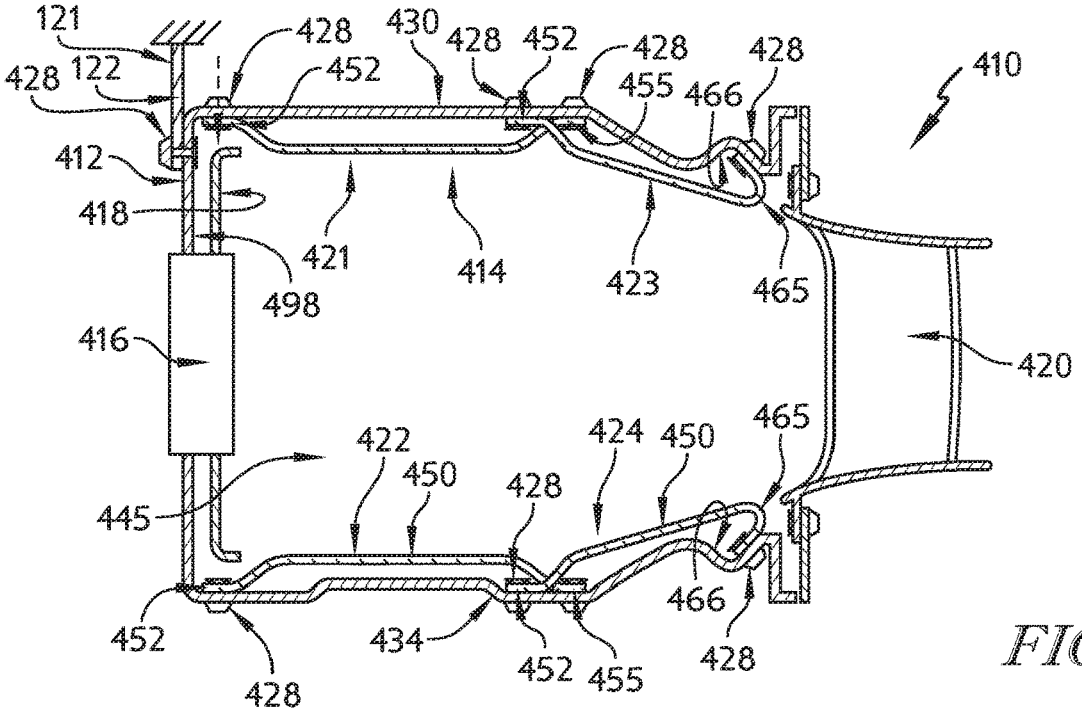
FIG. 7 is a partial cross-sectional view of a fourth combustor showing that the combustor includes a metallic shell, a ceramic liner made up of a plurality of ceramic tiles, a fuel nozzle, and a heat shield.

Another illustrative combustor 410 adapted for use in the gas turbine engine 110 is shown in FIG. 7. The combustor 410 is substantially similar to the combustor 210 shown in FIGS. 3-4 described herein. Accordingly, similar reference numbers in the 400 series indicate features that are common between the combustor 210 and the combustor 410. The description of the combustor 210 is hereby incorporated by reference to apply to the combustor 410, except in instances when it conflicts with the specific description and drawings of combustor 410.

Unlike the combustor 210, the combustor 410 includes a shell 410 having contoured outer and inner shell members 430, 432 as shown in FIG. 7. The contoured outer and inner shell members 430, 432 define the shape of the combustion chamber 445.

Figure 8:
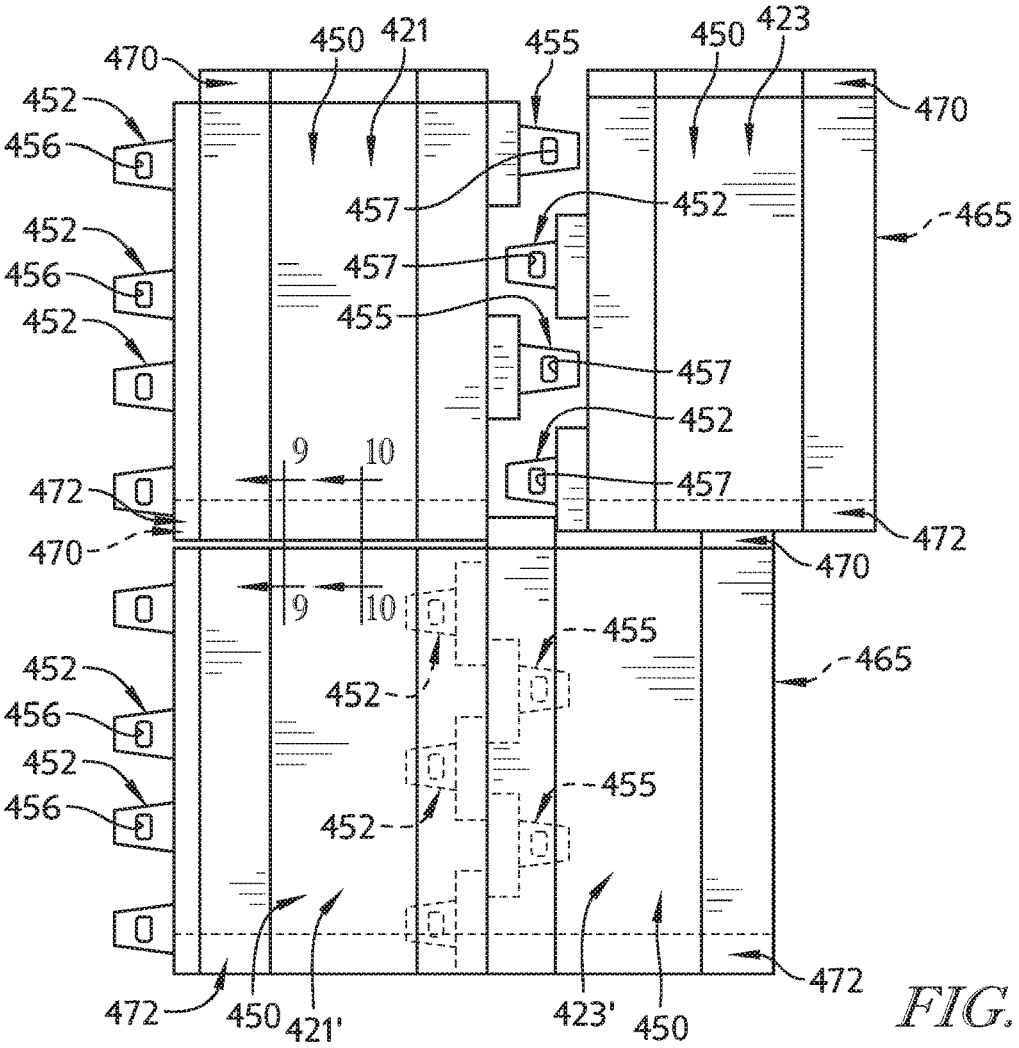
FIG. 8 is an internal plan view of some of ceramic tiles included in the combustor of FIG. 7 showing that the ceramic tiles include preformed apertures that receive fasteners for locating and securing the ceramic tiles to the metallic shell while allowing expansion and contraction of the ceramic tiles in the circumferential direction.

Also, unlike the combustor 210, the combustor 410 includes ceramic tiles 421-424 that do not include circumferentially-extending tabs as shown in FIG. 8. Rather the ceramic tiles 421-424 include circumferentially extending shelves 470, 472 that cooperate to formed ship lapped joints 475 with circumferentially-adjacent ceramic tiles (e.g. 421', 423') as suggested in FIGS. 8, 9, and 10. The ship lapped joints 475 provide a labyrinth like seal between circumferentially-adjacent ceramic tiles and adds stiffness to the liner 414.

In addition to axially-extending tabs 454 that are arranged along the forward side of the axially-forward ceramic tiles 421, 422, the axially-forward ceramic tiles 421, 422 include axially-extending tabs 455 arranged along an aft side of the axially-forward ceramic tiles 421, 422 as shown in FIG. 8. The axially-extending tabs 455 are secured to the shell 412 by metallic fasteners 428 that extend through circumferentially elongated slots 457. The axially-extending tabs 455 and the metallic fasteners 428 are shielded from the combustion chamber 445 by the body 450 of the axially-aft ceramic tiles 423, 424 as shown in FIG. 7.

In addition to axially-extending tabs 454 that are arranged along the forward side of the axially-aft ceramic tiles 423, 424, the axially-aft ceramic tiles 423, 424 include porpoise seals 465 arranged along an aft side of the axially-aft ceramic tiles 423, 424 as shown in FIG. 7. The porpoise seals 465 are received in V-shaped channels 466 formed by the shell 412 and are secured to the shell 412 by metallic fasteners 428 that extend through circumferentially elongated slots (not shown). The porpoise seals 465 and the metallic fasteners 428 are shielded from the combustion chamber 445 by the body 450 of the axially-aft ceramic tiles 423, 424 as shown in FIG. 7. While not specifically shown, fasteners 428 may be actively cooled as described elsewhere herein.

Figure 9:
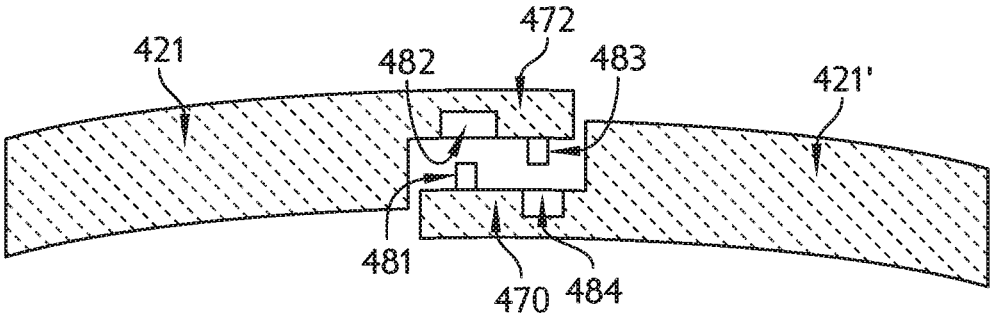
FIG. 9 is a partial cross-sectional view of FIG. 8 showing that the ceramic tiles form a ship lapped joint with circumferentially adjacent tiles that are tied together with tabs.

In the illustrative embodiment, circumferentially-adjacent tiles 421, 421' are interlocked using interlocking tabs 481, 483 received in slots 482, 484 as shown in FIG. 9. The joint established as a result of interlocking neighboring tiles 421, 421' using the interlocking tabs 481, 483 may reduce leakage. For the purpose of the present disclosure, the interlocking tabs 481, 483 discussed with respect to FIGS. 8 and 9 may not be used on either the first tile or the last tile of the CMC combustor liner.

Figure 10:
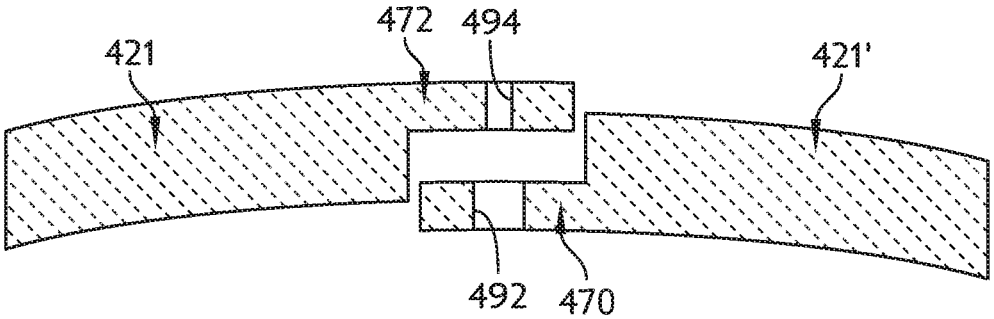
FIG. 10 is another partial cross-sectional view of FIG. 8 showing that the inner and outer elements of overlapping tiles may have different heat transfer treatments.

In the illustrative embodiment, the overlapping shelves 470, 472 include a cold-side shelf 470 and a hot-side shelf 472 as shown in FIG. 10. The cold-side shelf 470 may be exposed to active cooling via impingement holes or the like from the shell 412. The cold-side shelf 470 may be formed to include a relatively-large diameter cooling hole 492 that aligns with a relatively-small diameter cooling hole 494 formed in the hot-side shelf 472. These cooling holes 492, 494 may be adapted to conduct active cooling air to the hot-side shelf 472 during use of the combustor 410.

Ceramic combustor liners such as CMC liners often require less cooling than metal alloys typically used combustors and turbines, and the reduction in liner cooling permits a flattening of the combustor profile to be achieved. In turn, higher turbine inlet temperatures and flatter combustor profiles lead to reduced NOx emissions. Furthermore, reduced liner cooling allows a greater fraction of airflow in the gas turbine engine to be dedicated to the combustion process. As a result, in a "lean" burn application, greater airflow for combustion provides a reduction in emissions and/or provides a greater temperature increase for a given emissions level. In a "rich" burn application, greater airflow for combustion allows more air used to be used for quenching and provides reduced NOx emissions.

With regard to fabrication, one driving cost of a CMC combustor liner fabrication process is furnace time, which may be approximately three weeks. Given the high temperatures that must be maintained to properly cure CMC combustor liner components, the cost of the CMC combustor liner fabrication process may be high. For a single wall integrated (monolithic/annular) CMC combustor liner, the design and shape of the liner may allow for only one combustor to be cured at a time in a furnace. However, using a tiled CMC liner design as described herein allows tiles for several combustors to be cured at the same time which provides a dramatic cost savings. For example, the overall cost of a fabrication process for a CMC tiled liner design may be one half of the cost of the single wall CMC liner design for an annular wall liner of the same size.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A combustor for use in a gas turbine engine, the combustor comprising an annular metallic shell forming an annular cavity around a central reference axis, and an annular liner arranged in the annular cavity of the annular metallic shell along an annular combustion chamber inside the annular metallic shell, the annular liner including a plurality of ceramic tiles arranged around the central reference axis and located to shield an axially-extending wall of the annular metallic shell from burning fuel in the combustion chamber, wherein a first ceramic tile of the plurality of ceramic tiles includes a first shelf that cooperates with a second shelf in a circumferentially adjacent second ceramic tile of the plurality of ceramic tiles to form a ship lapped joint that provides a labyrinth-like seal between the first ceramic tile and the second ceramic tile, wherein the first shelf is arranged in direct confronting relation to the combustion chamber and the second shelf is shielded by the first shelf from the combustion chamber, wherein the first ceramic tile includes a tab that extends circumferentially from the first shelf of the first ceramic tile into a slot formed in the second shelf of the second ceramic tile to interlock the first ceramic tile and the second ceramic tile.

2. The combustor of claim 1, wherein the first shelf has a radial thickness that is less than a maximum radial thickness of the first ceramic tile and the second shelf has a radial thickness that is less than a maximum radial thickness of the second ceramic tile.

3. The combustor of claim 1, wherein the slot formed in the second shelf of the second ceramic tile extends a circumferential distance greater than a circumferential distance of the tab of the first ceramic tile.

4. The combustor of claim 1, wherein the second ceramic tile includes a tab that extends circumferentially from the second shelf of the second ceramic tile into a slot formed in the first shelf of the first ceramic tile to further interlock the first ceramic tile and the second ceramic tile.

5. The combustor of claim 1, further comprising fuel nozzles configured to provide fuel to the combustion chamber and a heat shield arranged to protect a forward side of the annular metallic shell from burning fuel in the combustion chamber, wherein the heat shield is formed to include openings that allow the fuel nozzles to access the combustion chamber.

6. The combustor of claim 5, wherein a forward portion of each of the plurality of ceramic tiles is arranged radially outward of and axially overlaps with the heat shield.

7. The combustor of claim 6, wherein the forward portion of each of the plurality of ceramic tiles are coupled to the annular metallic shell for movement relative to the annular metallic shell during operation of the combustor.

8. The combustor of claim 6, wherein fasteners extend from the forward portions of the plurality of ceramic tiles to the annular metallic shell to couple the plurality of ceramic tiles to the annular metallic shell.

9. The combustor of claim 8, wherein at least one of the fasteners is formed to include a passageway configured to carry cooling air from outside the annular metallic shell into the combustor that is discharged toward the heat shield to cool the heat shield.

10. A combustor for use in a gas turbine engine, the combustor comprising an annular metallic shell forming an annular cavity around a central reference axis, and an annular liner arranged in the annular cavity of the annular metallic shell along an annular combustion chamber inside the annular metallic shell, the annular liner including a plurality of ceramic tiles arranged around the central reference axis and located to shield an axially-extending wall of the annular metallic shell from burning fuel in the combustion chamber, wherein a first ceramic tile of the plurality of ceramic tiles includes a first shelf that cooperates with a second shelf in a circumferentially adjacent second ceramic tile of the plurality of ceramic tiles to form a ship lapped joint that provides a labyrinth-like seal between the first ceramic tile and the second ceramic tile, wherein the first shelf is arranged in direct confronting relation to the combustion chamber and the second shelf is shielded by the first shelf from the combustion chamber, wherein the second shelf is a cold-side shelf as it is shielded from the combustion chamber and the cold-side shelf is formed to include a cooling hole that extends radially through the cold-side shelf.

11. The combustor of claim 10, wherein the first shelf is a hot-side shelf as it is in direct confronting relation to the combustion chamber and the hot-side shelf is formed to include a cooling hole that extends radially through the hot-side shelf.

12. The combustor of claim 11, wherein the cooling hole formed in the cold-side shelf has a diameter greater than the cooling hole formed in the hot-side shelf.

13. The combustor of claim 12, wherein the cooling hole formed in the cold-side shelf is circumferentially and axially aligned with the cooling hole formed in the hot-side shelf so that cooling air may be conducted therethrough during use of the combustor.

14. The combustor of claim 11, wherein the cooling hole formed in the cold-side shelf is circumferentially and axially aligned with the cooling hole formed in the hot-side shelf so that cooling air may be conducted therethrough during use of the combustor.

15. A combustor for use in a gas turbine engine, the combustor comprising a metallic shell forming an annular cavity around a central reference axis, a liner arranged in the annular cavity of the metallic shell along a combustion chamber inside the metallic shell, the liner including a plurality of ceramic tiles arranged around the central reference axis and located to shield an axially-extending wall of the metallic shell from burning fuel in the combustion chamber, fuel nozzles configured to provide fuel to the combustion chamber, and a heat shield arranged to protect a forward side of the metallic shell from burning fuel in the combustion chamber, the heat shield formed to include openings that allow the fuel nozzles to access the combustion chamber, wherein a forward portion of each of the plurality of ceramic tiles is arranged radially outward of and axially overlaps with the heat shield, wherein fasteners extend from the forward portions of the plurality of ceramic tiles to the metallic shell to couple the plurality of ceramic tiles to the metallic shell and the fasteners are arranged radially outward of and axially overlap with the heatshield so that the fasteners are shielded from heat generated in the combustion chamber.

16. The combustor of claim 15, wherein the forward portion of each of the plurality of ceramic tiles are coupled to the metallic shell for movement relative to the metallic shell during operation of the combustor.

* * * * *